US005176091A

United States Patent [19]

Burnham, II

[11] Patent Number: 5,176,091

[45] Date of Patent: Jan. 5, 1993

[54] SAILBOARD PONTOON AND MAST RIGGING ASSEMBLY

[76] Inventor: Raymond M. Burnham, II, 244 Cedar St., Fiskdale, Mass. 01518

[21] Appl. No.: 659,232

[22] Filed: Feb. 22, 1991

[51] Int. Cl.[5] ..... B63H 9/00

[52] U.S. Cl. ..... 114/39.2; 114/91; 114/93; 114/102; 114/123

[58] Field of Search ..... 114/39.2, 123, 61, 91, 114/93, 111, 223, 102, 103; 280/810

[56] References Cited

U.S. PATENT DOCUMENTS

| | | | |
|---|---|---|---|
| 2,585,599 | 2/1952 | Tchetchet | 114/61 |
| 4,136,414 | 1/1979 | Popkin | 114/61 |
| 4,192,247 | 3/1980 | Riordan | 114/91 |
| 4,777,897 | 10/1988 | McKenna | 114/61 |

FOREIGN PATENT DOCUMENTS

| | | | |
|---|---|---|---|
| 26721 | 4/1981 | European Pat. Off. | 114/123 |
| 2048980 | 3/1972 | Fed. Rep. of Germany | 114/91 |
| 2843674 | 2/1980 | Fed. Rep. of Germany | 114/39.2 |
| 3223210 | 12/1983 | Fed. Rep. of Germany | 114/39.2 |
| 3321219 | 12/1984 | Fed. Rep. of Germany | 114/39.2 |
| 2448988 | 10/1980 | France | 280/810 |
| 2538339 | 6/1984 | France | 114/39.2 |
| 7607325 | 7/1976 | Netherlands | 114/93 |
| 8303996 | 6/1985 | Netherlands | 114/93 |
| 2084521 | 4/1982 | United Kingdom | 114/39.2 |

*Primary Examiner*—Sherman Basinger
*Assistant Examiner*—Thomas J. Brahan
*Attorney, Agent, or Firm*—John P. McGonagle

[57] ABSTRACT

A pontoon and mast rigging assembly for a sailboard. Four pontoons are arranged laterally about the sailboard hull and attached thereto by means of individual outriggers. Individual elastic straps interconnect each pontoon with a mast top mounted above and around the mast head.

7 Claims, 7 Drawing Sheets

SAILBOARD PONTOON AND MAST RIGGING ASSEMBLY

BACKGROUND OF THE INVENTION

This invention relates to sailboards and, more particularly, to accessories which enable learners to more easily master the art of sailboard riding, i.e., windsurfing.

Sailboards are inherently difficult to ride and sail. Beginners may spend many hours mastering the arts of controlling and steering the sailboard. It can easily take forty hours, including teaching and practice, before the beginner can simply take a sailboard out and bring it back on flat water with a steady, gentle breeze.

The beginning windsurfer faces three major difficulties in learning to ride and sail a sailboard: (i) falling off the sailboard as it tips from side to side, (ii) dropping the sail, and again falling off, as the sail collects breezes or gusts, and (iii) learning to steer the sailboard without a rudder and with only a mobile sail attached to a mobile mast. Of the three difficulties, the first requires the least mental learning but the most physical learning. The third difficulty requires the most mental learning, but the least physical learning.

It has long been known that outriggers and floats can be used to provide stability to watercraft. Likewise, it has long been known that the use of guy-wires with a sail mast will help keep a mast upright. Although over twelve million people, world-wide, currently windsurf on occasion, and many more millions have tried, the present invention, to applicant's knowledge, is the first application to sailboards of any prior art technique which solves the problem of the mast falling into the water because the beginner lets go of the sail mast to avoid falling. Since this is, by far, any beginner's most serious problem in learning to windsurf, the present invention will have a high level of utility. In solving that problem, the present invention also solve's the beginner's other major problems: the sailboard's tendency to tip thus causing him to fall off, difficulty in holding the sail against the strength of the wind, learning to steer the sailboard, and the sailboard's excessive maneuverability.

SUMMARY OF THE INVENTION

In view of the foregoing problems inherent with learning to windsurf, the present invention provides a sailboard accessory comprised of a pontoon and mast rigging assembly which will keep the sailboard steady and hold the mast of the sail upright. As such, the general purpose of the present invention, which will be described subsequently in greater detail, is to provide a sailboard accessory which will allow the beginning windsurfer to quickly and easily learn to stay on the sailboard and to steer the sailboard with its mobile mast and sail.

To attain and meet these purposes, the present invention provides four pontoons, two positioned laterally forward and two positioned laterally rearward about and attached to the sailboard. Elasticized straps which attach the mast top to each pontoon are also provided. The present invention therefore allows the beginning windsurfer to solve his most difficult mental learning problem first. Then, once he has learned to sail the sailboard, it allows him to loosen the mast rigging, and soon to remove it entirely, as it becomes easier and easier for him to control the mast and to sail. Finally, it then allows him, once he has learned to sail the sailboard and to control the sail with ease, to remove the pontoon system and then to focus on and master the problem of balance, which is made vastly easier since he has, by now, learned to use the sail to catch the wind and to thereby give him something to hold onto if he feels himself losing his balance.

The present invention also solves a further problem met by the novice windsurfer, i.e., a sailboard's excessive maneuverability. Friction from the four pontoons in the water will provide torque inertia and thereby keep the sailboard from turning in the water except when turning is desired.

These together with other objects of the invention, along with various features of novelty which characterize the invention, are pointed out with particularity in the claims annexed hereto and forming a part of this disclosure. For a better understanding of the invention, its operating advantages and the specific objects attained by its use, reference should be made to the accompanying drawings and descriptive matter in which there is illustrated a preferred embodiment of the invention.

DETAILED DESCRIPTION OF THE PREFERRED EMBODIMENT

Figure 1:
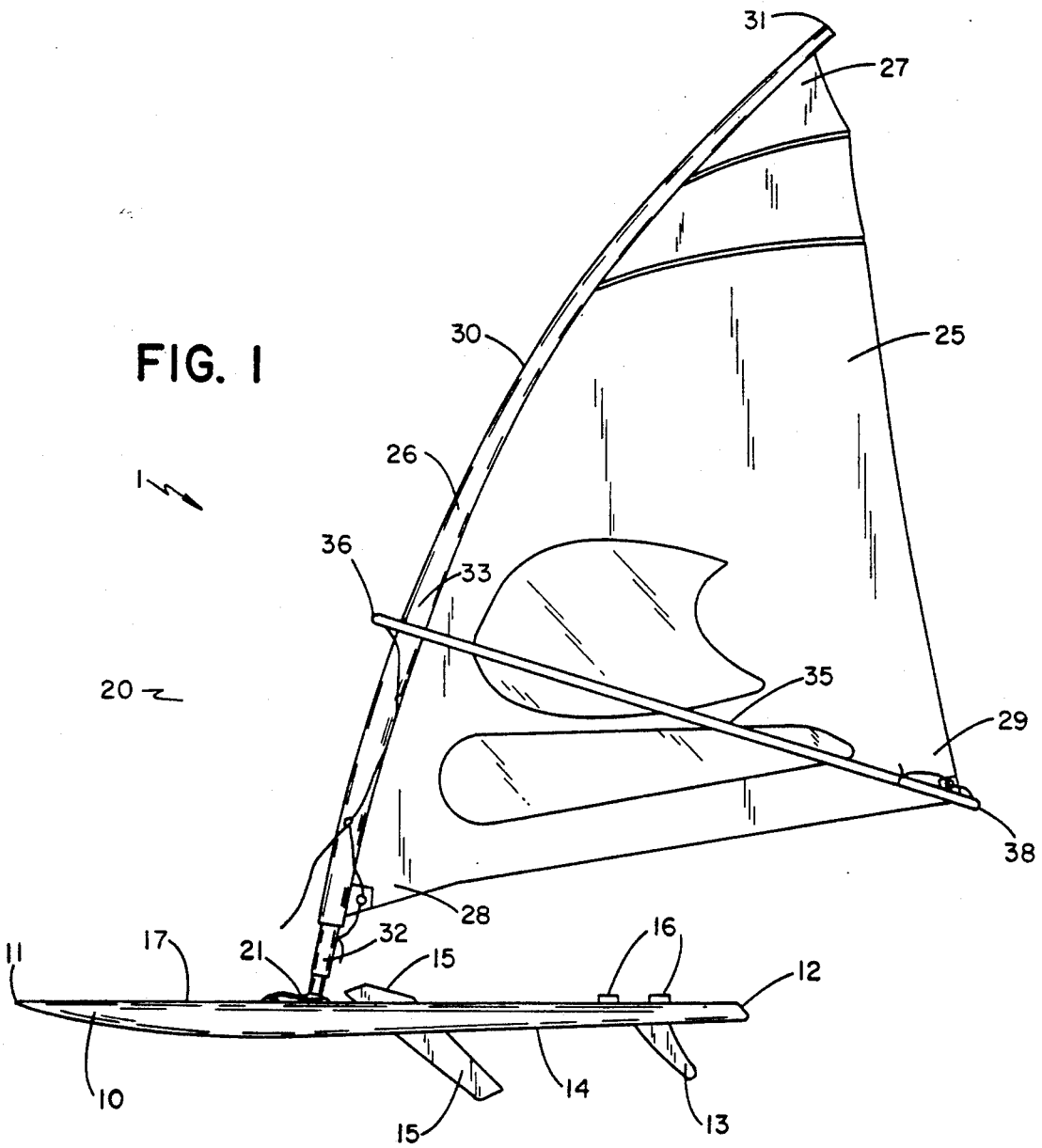
FIG. 1 is a side elevational view of a standard sailboard with standard windsurfing mast and sail arrangement.
Figure 2:
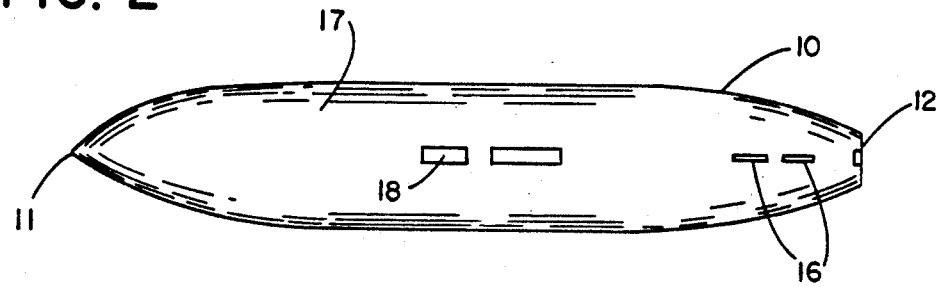
FIG. 2 is a top plan view of a standard sailboard hull.
Figure 3:
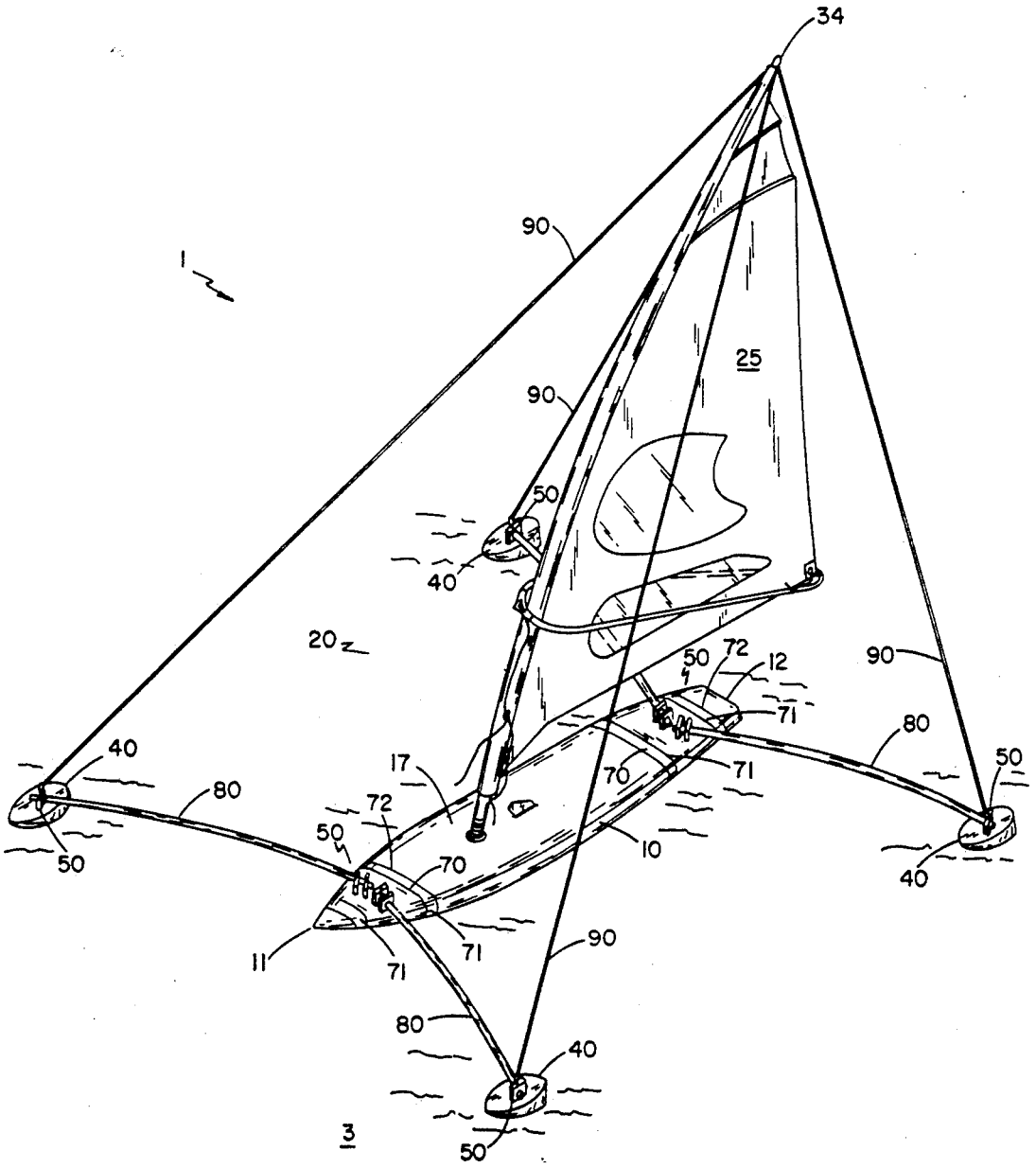
FIG. 3 is a perspective view of a standard sailboard having a pontoon and mast rigging assembly in accordance with the present invention.
Figure 4:
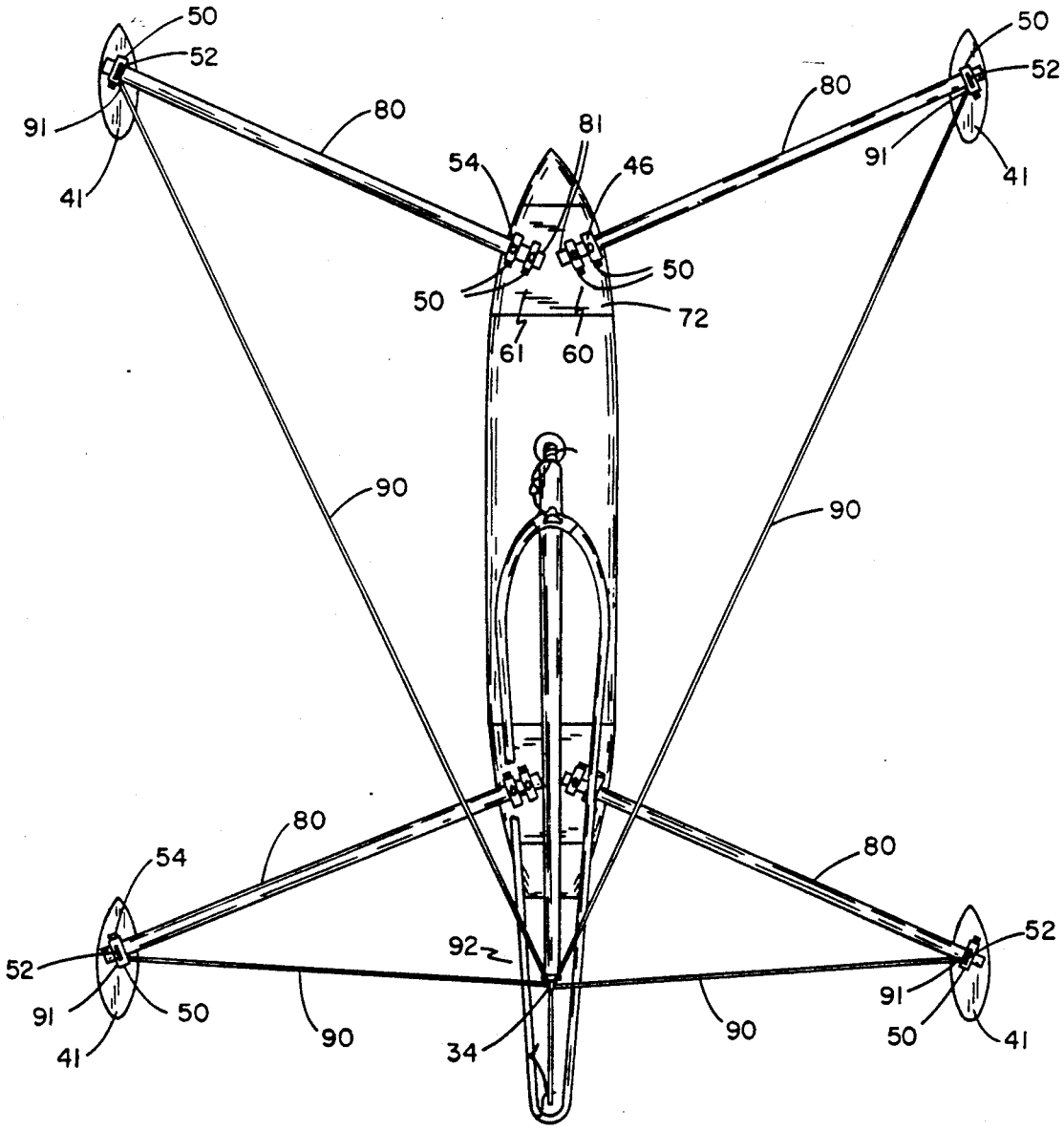
FIG. 4 is a top plan view of the sailboard of FIG. 3.
Figure 5:
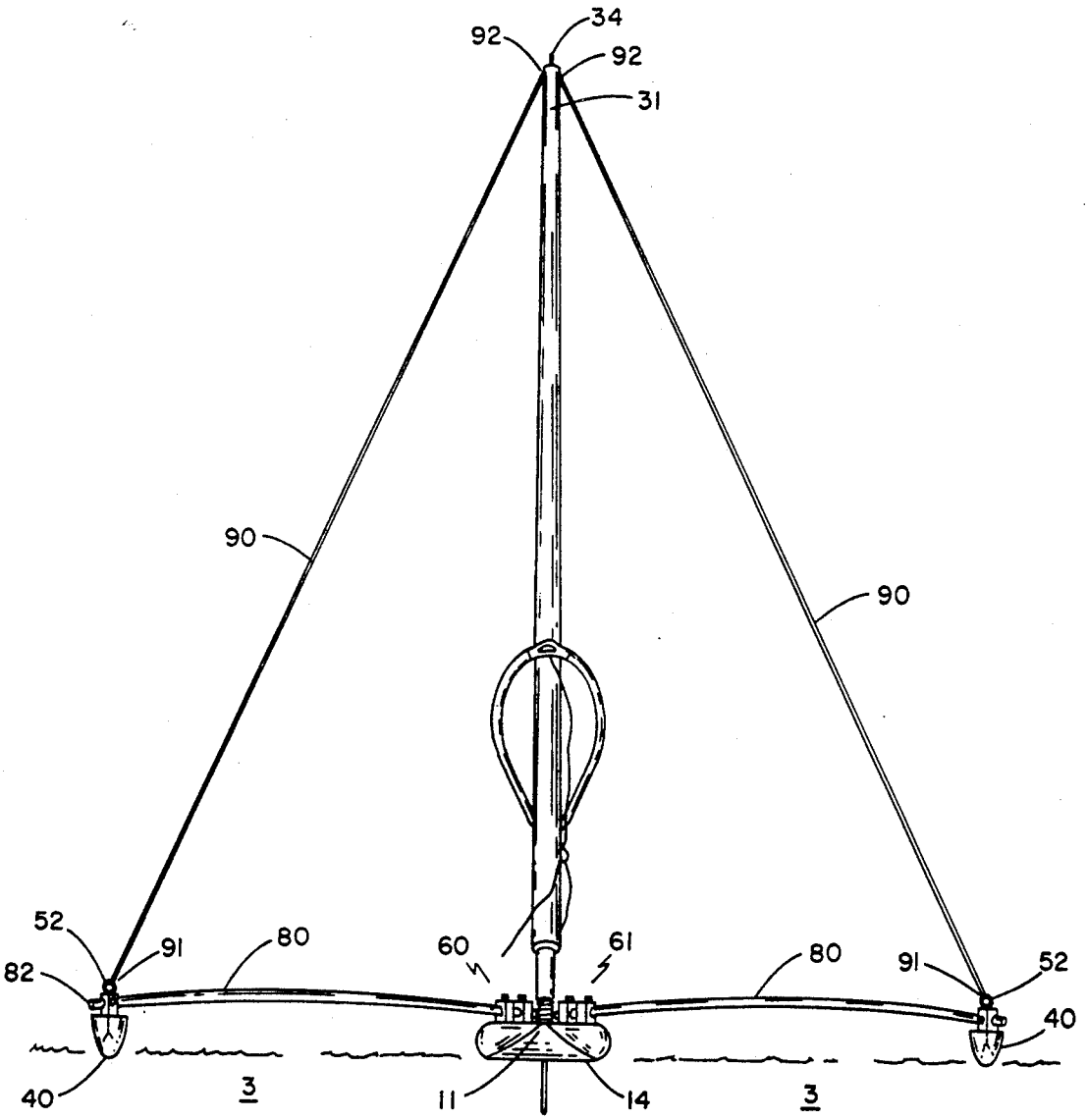
FIG. 5 is a front elevational view of FIG. 3.
Figure 6:
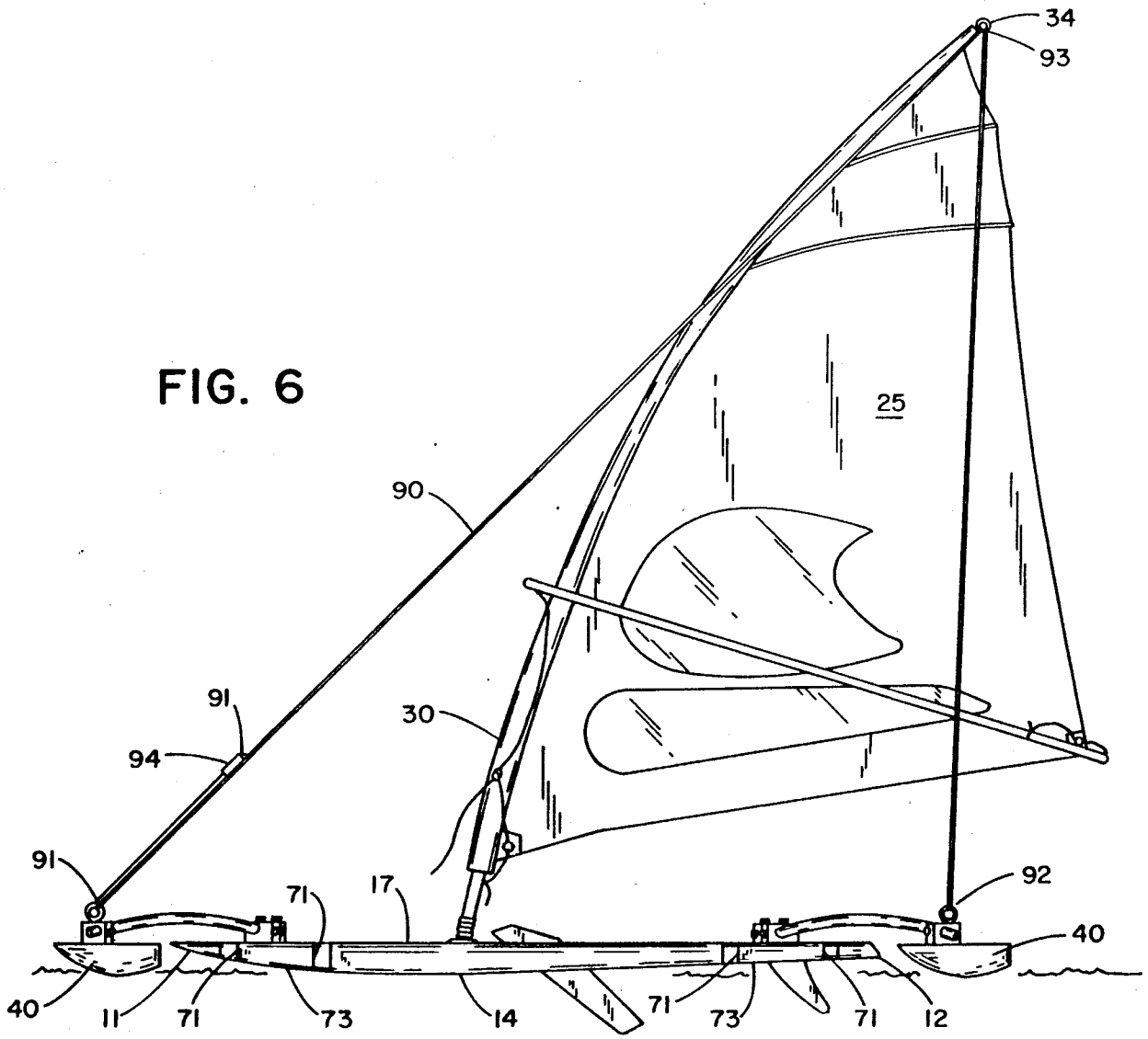
FIG. 6 is a side elevational view of FIG. 3.
Figure 7:
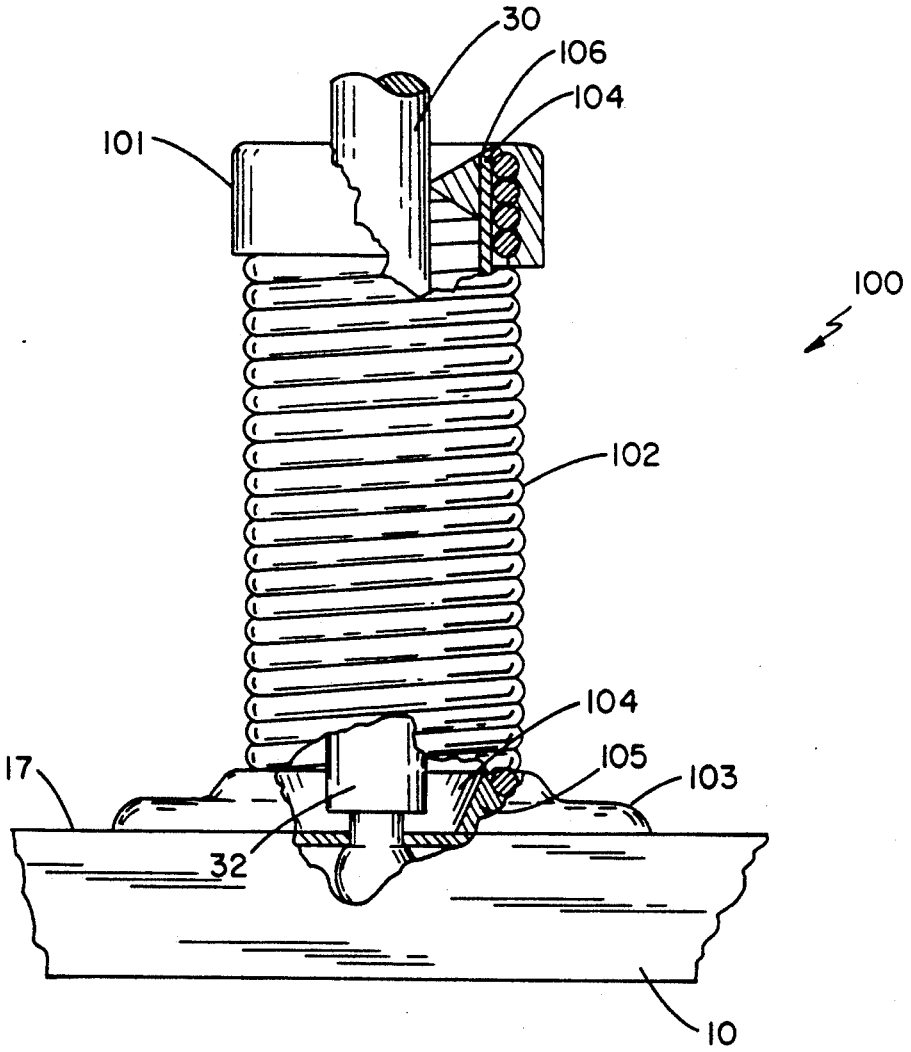
FIG. 7 is a side elevational view of a sailboard spring tube.

Referring to the drawings in detail wherein like elements are indicated by like numerals, there is shown in FIG. 1 a side elevational view of a standard sailboard 1 with standard windsurfing mast and sail arrangement 20. FIG. 2 is a top plan view of a standard sailboard hull 10 without mast and sail arrangement 20. The sailboard hull 10 has a nose or bow 11 at its forward end, tail or stern 12 at its rearward end, and is generally flat in the horizontal plane. The sailboard hull template is generally elongated with a pointed bow 11 and blunted stern 12. The sailboard hull 10 has one or more skegs or fins 13 attached to its undersurface 14 near the stern 12. The sailboard hull 10 also has a retractable daggerboard 15 positioned at the approximate midpoint of the hull 10. Most sailboard hulls 10 today also have a plurality of footstraps 16 mounted on the hull upper surface 17 rearward of the daggerboard 15. The footstraps 16 keep the sailor firmly attached to the sailboard hull 10 while going out in surf or high wind and they also help him or her to direct the sailboard hull 10 with foot pressure.

The mast and sail arrangement 20 is comprised of a mast or spar 30, sail 25, and a wish-bone shaped boom 35. The mast 30 is made from fiberglass or aluminum, with a single or double taper. The mast 30 is secured to the sailboard hull 10 through a flexible or universal joint 21 made to lock into a mast foot well 18 located into the sailboard hull upper surface 17 just forward of the daggerboard 15. The joint 21 enables the mast 30 to be swivelled through a 360 degree radius to accommodate various wind directions and also to be tipped in any direction relative to the sailboard hull 10. The ability of the mast 30 to be tipped is important because basic steering is accomplished by tipping the sail 25 forward and backward in line with the sail's chord line. The effect of this is that the center of effort in the sail 25 will move in front of or behind the center of lateral resistance of the sailboard hull 10, i.e., the dagger board 15, which acts as the sailboard pivot point.

The sail 25 has a mast sleeve 26 formed along one side. The sail 25 is joined to the mast 30 by sliding the mast sleeve 26 over the mast 30. The head 27 of the sail 25 reaches nearly to the mast head 31. The tack 28 of the sail 25 reaches nearly to the mast foot 32.

A wish-boned shaped boom 35 is attached at its front end 36 to the mast 30 at a point 33 on the mast 30 approximately one-third of the mast length from mast foot 32 to mast head 31. The boom 35 is fitted approximately horizontally about the sail 25 with the sail clew 29 being tied to the boom rear end 38. Booms 35 may be fixed or of variable length.

As may be best seen from FIG. 1, a windsurfing sailor will stand on the sailboard hull upper surface 17 with his or her feet inserted into the various footstraps 16 just aft of the daggerboard 15. The windsurfer then holds onto the boom 35 while balancing himself or herself on the sailboard hull 10. From this Figure It is easy to understand the inherent difficulty involved in learning how to windsurf.

FIGS. 3–6 illustrate a sailboard 1 with mast and sail arrangement 20 constructed with a pontoon and mast rigging assembly in accordance with the present invention. The pontoon and mast riggin assembly of the present invention is comprised of the following elements: four pontoons 40, twelve blocks 50, two sheathes 70, four outriggers 80, two or four elastic straps 90, and a mast top 34.

The two sheathes 70, made of semi-flexible plastic, are laterally placed about the sailboard hull 10, one near to the bow 11 and the other near to the stern 12. Each sheath 70 is held in place about the sailboard hull 10 by means of two band clamps 71 to make them immobile. Each sheath 70 has an outer 72 and inner 73 surface and is contoured to fit about the hull 10.

Figure 8B:
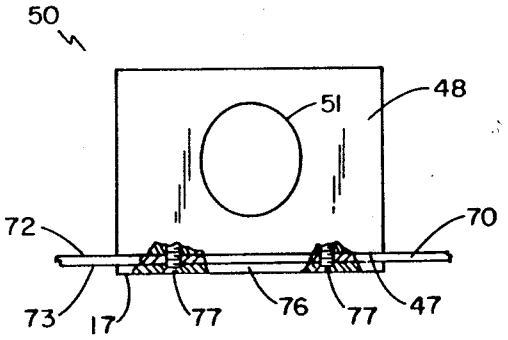
FIG. 8B is a side view of the block of FIG. 8A attached to a hull sheath.
Figure 8A:
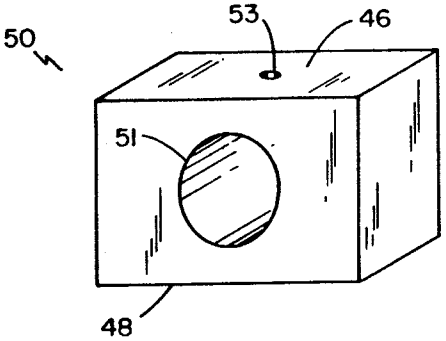
FIG. 8A is a side perspective view of an invention block used on a hull sheath.
Figure 8C:
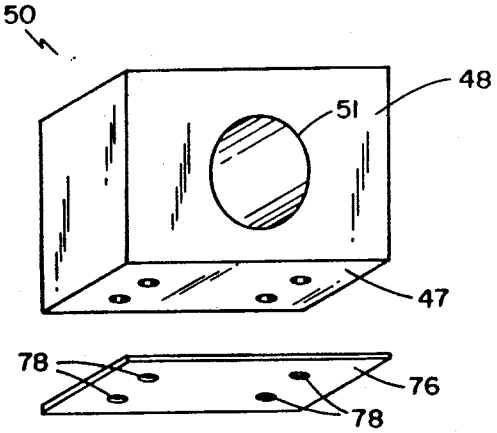
FIG. 8C is a bottom side perspective view, partially exploded, of the block of FIG. 8B.

Each sheath 70 has four blocks 50 attached to its outer surface 72. As may be best understood from FIGS. 8A, 8B and 8C, as well as FIGS. 3–7, Each block 50 is made of a stiffened, molded plastic material such as Delrin, and has a top 46, bottom 47, two sides 48, front 49 and back 45. Each block 50 has a round, oval or elliptical cavity 51 formed centrally through from one side 48 to the other 48. The major axis of the oval or elliptical cavity 51 is positioned perpendicular to the block's top 46 and bottom 47. Each block 50 is attached to a sheath 70 by means of a flat, optional, holding piece 76. In this embodiment of the invention, each holding piece 76 has four, pre-drilled screw holes 78 formed therein. The holding piece 76 is positioned on the sheath's inner face 73, i.e., on the sailboard hull side 74 of the sheath 70. Screws 77 are placed through the holding piece screw holes 78, through the sheath 70, into the block's bottom surface 47.

Each sheath's four blocks 50 are formed into two sets. The forward sheath's first set 60 of blocks 50 is positioned to starboard (the right side of the board when looking from the stern 12 towards the nose 11) of the board's longitudinal center line. The blocks 50 within the set 60 are positioned in a side by side relationship and have a separation of from one to nine inches between them. The block cavities 51 are aligned so that their central axis is aligned along a forward, starboard transverse angle of fifteen to seventy-five degrees. The forward sheath's second block set 61 is positioned to port (the left side of the board when looking from the stern 12 towards the nose 11) of the board's longitudinal center line. The blocks 50 within the set 61 are positioned in a side by side relationship and have a separation of from one to nine inches between them. The block cavities 51 are aligned so that their central axis is aligned along a forward, port transverse angle of fifteen to seventy-five degrees. The rearward sheath 70 has a mirror block configuration.

Figure 9:
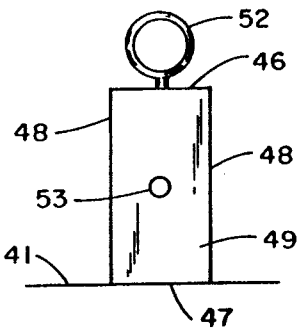
FIG. 9 is a front view of an invention block used on a pontoon.

The pontoons 40, which may be made of fiberglass, polyethylene, acrylic or other synthetic plastic material, and which may either be hollow or filled with foamed synthetic plastic material, such as styrofoam, polyurethane, polystyrene or the like, are each shaped like the keel and hull of any watercraft and provide buoyancy. The four pontoons 40 are positioned so that a pontoon 40 is positioned laterally forward to port, laterally forward to starboard, laterally rearward to port, and laterally rearward to starboard about the sailboard hull 10. Each pontoon 40 has a block 50 attached to its upper surface 41. Each block 50 is basically identical to the blocks 50 used on the sheathes 70 (but see FIG. 9). The pontoon blocks 50 do not use holding pieces 76 but rather are attached directly to the pontoon exterior upper surface 41. Each pontoon block 50 is so aligned that the central axis of its cavity 51 is aligned with the central axis of the nearest sheath block set 60 or 61 central axis.

The four outriggers 80 join the pontoons 40 to the sailboard hull 10. Each outrigger 80 is approximately ten feet long and is made of anodized aluminum tubing or similar slightly flexible material which has a round, oval or elliptical cross-section. The tubing 80 is positioned so that its cross-section minor axis is generally parallel with the water 3. Oval or elliptical cross sections provide greater strength and inflexibility to the outrigger 80. However, circular cross sections would cost less to produce. Each outrigger has two ends, a sailboard end 81 and a pontoon end 82. Each outrigger's pontoon end 82 is inserted into the cavity 51 of a particular pontoon block 50. The block cavity 51 cross-section is slightly larger that the outrigger 80 cross-section. The sailboard end 81 of each particular outrigger 80 is inserted into the cavities 51 of the nearest sheath block set 60 or 61. Each outrigger 80 is curved so that the pontoon end 82 and sailboard end 81 would be close to the water line 3 while the outrigger centers 83 would be raised well-above the water line 3. The arch of each outrigger 80 permits the outriggers 80 to avoid catching a wave and therefore avoid uneven drag.

Each pontoon block 50 also has a screw or pin hole 53 in its front side 49. The hole 53 extends into the side cavity 51. A thumbscrew or snap pin 54 is inserted into the hole 53 and provides means for securing the pontoon block 50 to the outrigger 80. The use of thumbscrews or snap pins 54 permit the use of outriggers 80 with circular cross-sections. Each sheath block 50 also has a screw or pin hole 53 in its top 46. The hole 53 extends into the side cavity 51. A thumbscrew or snap pin 54 is inserted into the hole 53 and provides means for securing each set of sheath blocks 50 to a particular outrigger 80.

The mast rigging assembly is comprised of a mast top 34 and four elastic straps 90. Each of the pontoon blocks 50 has a loop 52 attached to its top 46. One end 91 of each strap 90 is attached to a separate pontoon block loop 52. The other strap end 92 is attached to the mast top 34. The mast top 34 is made of a rigid plastic and, possibly, nylon webbing. The mast top 34 fits above and around the mast head 31 and is held in place by the force of the four elastic straps 90 pulling downward toward the pontoons 40. The straps 90 are elasticized to allow the mast 30, and thereby the sail 25, to be tipped. However, the straps 90 would provide increasingly stronger resistance the farther the mast top 34 was moved from an upright position.

In an alternate arrangement, only two straps 90 would be required. In this alternate arrangement both strap ends 91 and 92 would attach to the pontoons 40. One strap 90 would be attached to the fore and aft pontoons 40 on the port side, and the other strap 90 would be attached to the fore and aft pontoons on the starboard side. The strap centers 93 would be looped through the mast top 34 and would provide very little resistance to tipping the mast 30, and thereby the sail 25, toward the bow 11 or toward the stern 12.

In either embodiment, the mast 30 would be laterally held in place, and the mast/sail 30/25 would not drop. The strength of the strap's elasticity could be made adjustable by looping the strap lower end 91 through the pontoon block loop 52 and then securing the end 91 to the strap 90 part-way up with an adjustable buckle 94.

An alternative to the use of elasticized strapping 90 from the mast top 34 to the four blocks 50 at the pontoons 40 (to keep the mast 30 upright while allowing it some "give") is a spring tube 100 (see FIG. 7) which would attach to the sailboard hull 10 either directly or through the use of plastic sheathing 70. The spring tube 100 has a resilient collar 101, spring mechanism 102, and base plate 103. The base plate 103 is comprised of a flexible, cylindrical sheath 104 attached to a plate like member 105 which is attached to the sailboard hull upper surface 17 in place of the universal joint 21. The spring mechanism 102 is fitted over the cylindrical sheath 104. The spring mechanism 102 is held in place over the cylindrical sheath 104 by a resilient collar 101 attached to the upper end 106 of the sheath 104. The mast foot 32 is inserted into the cylindrical sheath 104. The spring mechanism 102, which may be a coil spring, flat spring, leaf spring, or resilient tube, acts against the weight of the sail 25 on the mast 30 to keep the mast 30 in an upright position. The spring tube 100 allows some angular movement while resisting hyper angular movement with respect to the sailboard hull 10, i.e., like the elasticized strapping 90, it would provide increasingly stronger resistance the farther the mast head 31 moved from an upright position.

Masts 30 currently must be made to easily tip over. Otherwise, when a windsurfer fell, the sail 25 on the mast 30 would tip the sailboard 1 over on its side. This would make the sailboard 1 virtually impossible to upright. Use of either the spring tube 100 or the strapping 90 alone would be impossible. However, when used with the pontoons 40, either the spring tube 100 or the strapping 90 will prove to be a functional and easy solution to the problem of the sail 25 and mast 30 not staying upright.

In operation, the beginning windsurfer starts with a stabilized sailboard 1 according to the present invention. The pontoons 40 provide a stable platform, i.e., hull 10, for the windsurfer. The windsurfer does not have to concern himself at this point with the sailboard's excessive maneuverability and inherent instability and can concentrate on learning to actually "sail" the sailboard 1. Once the windsurfer has learned to sail the sailboard 1, he can loosen the mast rigging 90, and soon remove it entirely, as it becomes easier and easier for him to control the mast 30 and to sail. Finally, once the windsurfer has learned to sail the sailboard 1 and to control the mast 30 and sail 25 with ease, he can the pontoon system, i.e., pontoons 40 and outriggers 80, and begin to focus on and master the problem of balance. This in now easier since the windsurfer 5 has, by now, learned to use the mast and sail arrangement 20 to catch the wind and to use the boom 35 to hold onto if he feels himself losing his balance.

It is understood that the above-described embodiments are merely illustrative of the application. Other embodiments may be readily devised by those skilled in the art which will embody the principles of the invention and fall within the spirit and scope thereof.

I claim:

1. A novice windsurfer's pontoon and mast rigging assembly for a windsurfing sailboard with a hull, mast with mast head and secured to said sailboard hull through a flexible universal joint enabling said mast to be swivelled through a 360 degree radius and tipped in any direction relative to said hull, boom and sail, comprising:

a plurality of pontoons fixedly positioned laterally about said hull;

a plurality of outriggers interconnecting each pontoon with said hull;

a mast top fitted to said mast head; and a plurality of mast supporting elasticized straps, each with two ends, adjustably interconnecting each pontoon to said mast top to vary the amount of support.

2. A pontoon and mast rigging assembly as recited in claim 1, said plurality of pontoons, outriggers, and straps comprises:

four pontoons positioned one each laterally forward to port, laterally forward to starboard, laterally rearward to port, and laterally rearward to starboard;

four outriggers one each joining each said pontoon to said sailboard hull; and four elasticized straps one each interconnecting each pontoon to said mast top.

3. A pontoon and mast rigging assembly as recited in claim 2, further comprising:

means for adjusting the tensioning of the straps.

4. A pontoon and mast rigging assembly as recited in claim 3, wherein:

said strap adjusting means is comprised of an adjustable buckle.

5. A pontoon and mast rigging assembly as recited in claim 1, said plurality of pontoons, outriggers, and straps comprises:

four pontoons positioned one each laterally forward to port, laterally forward to starboard, laterally rearward to port, and laterally rearward to starboard;

four outriggers one each joining each said pontoon to said sailboard hull; and two elasticized straps one of which interconnects the port side pontoons and through said mast top, and the other of which interconnects the starboard side pontoons through said mast top.

6. A pontoon and mast rigging assembly as recited in claim 5, further comprising:

means for adjusting the tensioning of the straps.

7. A pontoon and mast rigging assembly as recited in claim 6, wherein:

said strap adjusting means is comprised of an adjustable buckle.

* * * * *